US006123279A

United States Patent [19]

Stafford et al.

[11] Patent Number: 6,123,279

[45] **Date of Patent: *Sep. 26, 2000**

[54] ROCK CRUSHER HAVING CRUSHING-ENHANCING INSERTS, METHOD FOR ITS PRODUCTION, AND METHOD FOR ITS USE

[75] Inventors: Robert G. Stafford, Mequon, Wis.; J. Don Brock, Chattanooga, Tenn.; William R. Gray, New Berlin, Wis.; Herbert E. Jakob, Chattanooga, Tenn.

[73] Assignee: Astec Industries, Inc., Chattanooga, Tenn.

[ * ] Notice: This patent is subject to a terminal disclaimer.

[21] Appl. No.: 09/393,959

[22] Filed: Sep. 10, 1999

Related U.S. Application Data

[63] Continuation of application No. 08/960,671, Oct. 30, 1997, Pat. No. 5,967,431, which is a continuation of application No. 08/936,232, Sep. 24, 1997, abandoned, which is a continuation-in-part of application No. 08/618,286, Mar. 18, 1996, abandoned.

[51] Int. Cl.[7] ..... B02C 2/00

[52] U.S. Cl. ..... 241/30; 241/207; 241/264; 241/294; 241/300

[58] Field of Search ..... 241/30, 207, 264, 241/294, 300

[56] References Cited

U.S. PATENT DOCUMENTS

| | | | |
|---|---|---|---|
| 201,187 | 3/1878 | Markle | 241/300 |
| 273,477 | 3/1883 | Dodge | 241/300 |
| 883,619 | 3/1908 | Canda | 241/300 |
| 1,513,855 | 11/1924 | Phelps | 241/291 |
| 2,828,925 | 4/1958 | Rumpel | 241/267 |
| 3,241,777 | 3/1966 | Kuntz | 241/291 |
| 3,750,967 | 8/1973 | DeDiemar et al. | 241/267 |
| 3,804,345 | 4/1974 | DeDiemar | 241/267 |

*Primary Examiner*—Mark Rosenbaum
*Attorney, Agent, or Firm*—Nilles & Nilles SC

[57] ABSTRACT

A rock crusher such as a cone or jaw crusher incorporates hardened tapered inserts in the manganese or other wear liner of at least one of its crushing elements. The inserts extend outwardly from the crushing surface of the crushing element towards the facing crushing surface so as, in use, to act as pick axes that shatter rock primarily by impact rather than pulverizing the rock by compression. The inserts are fixed in a heat treated manganese wear liner either by bonding or by press-fitting. The inserts substantially improve the life of the wear liner and, unexpectedly, 1) produce product of a highly uniform gradation in the desired ranges, 2) consistently produce product with a very high cubicity, 3) dramatically reduce the crusher's power requirements, and 4) significantly increase the crusher's capacity.

13 Claims, 9 Drawing Sheets

ROCK CRUSHER HAVING CRUSHING-ENHANCING INSERTS, METHOD FOR ITS PRODUCTION, AND METHOD FOR ITS USE

DISCUSSION OF A RELATED APPLICATION

The present application is a continuation of U.S. application Ser. No. 08/960,671, filed Oct. 30, 1997 which issued as U.S. Pat. No. 5,967,431 on Oct. 19, 1999, which is a continuation of U.S. patent application Ser. No. 08/936,232, filed Sep. 24, 1997 (now abandoned), which is a continuation-in-part of U.S. patent application Ser. No. 08/618,286, filed Mar. 18, 1996 (now abandoned).

BACKGROUND OF THE INVENTION

1. Field of the Invention

The invention relates to rock crushers such as cone or jaw crushers and, more particularly, relates to a rock crusher having inserts disposed on at least one crushing surface thereof for enhanced crushing action, enhanced wear resistance, enhanced capacity, and reduced power requirements. The invention additionally relates to a method of fabricating a wear liner having such inserts and to an improved method of crushing rock.

2. Discussion of the Related Art

Rock crushers have been used for centuries in quarry operations and the like to break large pieces of material, such as rock, stone and the like (hereinafter "rock"), into smaller pieces more suitable for applications such as road paving. There are many types of rock crushers including: cone crushers (also known as gyratory crushers), jaw crushers, impactors, hammermills, and pulverizers to name a few.

Cone or gyratory crushers include an eccentrically gyratory conical head, an opposed bowl, and a crushing cavity or crushing chamber formed between the head and the bowl. Rock that falls into the crushing chamber is crushed by compression to a smaller size generally consistent with the size of the gap in the crushing cavity at the point at which the rock is struck. The average size of the stone formed from the crushing operation can be changed by adjusting the minimum gap between the bowl and the head, which minimum gap is known in the art as "the closed side setting." For a more detailed description of the operation of a cone crusher, reference may be had to U.S. Pat. No. 3,750,967 to DeDiemar et al., entitled "Gyratory Crusher Having Interchangeable Head Mantles," issued Aug. 7, 1973 and assigned to an assignee common with the present invention (hereinafter incorporated by reference).

A jaw crusher includes opposed generally rectangular dies, one of which is swingably movable relatively toward and away from the other to crush rock therebetween. For a more detailed description of the operation of a jaw crusher, see U.S. Pat. No. 3,804,345 to DeDiemer, entitled "Jaw Crusher Die Mounting," issued Apr. 16, 1979, and assigned to an assignee common with the present invention (hereinafter incorporated by reference).

The crushing surfaces of both cone crushers and jaw crushers suffer from severe and relatively rapid wear due to abrasive contact with the stone being crushed. In order to ameliorate this wear, both cone crushers and jaw crushers typically utilize as one and usually both crushing surfaces a replaceable hardened, wear-resistant manganese wear liner. A jaw crusher incorporating replaceable manganese wear liners is disclosed, for example, in U.S. Pat. No. 2,828,925 to Rumpel. A gyratory or cone crusher incorporating replaceable manganese wear liners is disclosed, for example, in the DeDiemer '967 patent.

While manganese wear liners serve to increase the useful life of the crushing elements of a crusher, they are not a cure-all for all of a crusher's problems.

For instance, manganese wear liners still exhibit relatively rapid and uneven wear, particularly when subject to contact with an abrasive material such as sandstone. They therefore must be replaced relatively frequently—on the order of every 10 days to 3 weeks in the case of a cone crusher crushing sandstone. The manganese wear liners are relatively expensive, and their replacement requires several hours of down time. Frequent replacements of wear liners therefore can be quite costly.

Another problem that is associated with conventional crushers and that is not solved by traditional wear liners is that their crushing action does not consistently produce a product of sufficiently high cubicity. Cubicity is defined as the ratio of length to width to thickness of a sample particle. For instance, a particle having a length of 4", a width of 2", and a thickness of 1" has a 4:2:1 cubicity ratio. Many industries, and particularly the paving industry, increasingly are requiring the production of gravel or other paving materials of consistent, relatively high cubicity. This need is particularly evident in the case of materials designed for use in so-called "super paving" projects in which state highway departments require that no more than 15% of the crushed rock used in the paving materials may have a cubicity ratio of greater than 3:1:1. Operators of most cone and jaw crushers (the crushers most commonly used to produce materials for the paving industry) sometimes find it exceedingly difficult to meet these cubicity requirements, particularly if the materials being crushed are shale-like or otherwise tend to shatter into long, flat pieces. Crushed product failing to meet the cubicity requirements cannot be screened or otherwise improved to meet these requirements and hence must be rejected. As a result, it is not uncommon for a state highway department to reject several hundred thousand tons of rock produced for use in a super paving project.

The industry has recently addressed the cubicity problem and solved it to a limited extent by increasing the stroke and speed of crushing machines. For instance, crushed rock produced by the Telsmith H-Series crusher exhibits improved cubicity when compared to materials produced by other, earlier crushers. However, meeting cubicity requirements for super paving projects is often difficult even with these modern crushers, particularly when the rock is inherently relatively non-cubic, i.e., it tends to break into long, flat pieces.

Proposals have been made to incorporate inserts into a crushing surface of a crusher. For instance, U.S. Pat. No. 201,187 to Markel and U.S. Pat. No. 273,477 to Dodge both disclose jaw crushers having replaceable pins or points that are designed to absorb the abrasive action of the stone being crushed and hence to form the wear surface of the crusher. Replacement of these pins or points apparently was considered to be a more attractive option than replacing an entire die or even an entire liner of a crusher. U.S. Pat. No. 883,619 to Canda similarly discloses the use of hardened steel ribs which are connected to the dies of the jaws and which form the wear elements of the crusher.

Proposals have also been made to insert elements into the crushing surface of a jaw crusher to enhance its crushing ability. For instance, U.S. Pat. No. 1,513,855 to Phelps proposes the incorporation of differently-sized crushing and cutting teeth into the facing dies to give the machine increased capacity. Similarly, U.S. Pat. No. 3,241,777 to Kuntz proposes the attachment of hardened steel balls to the opposed dies of a jaw crusher to act as a wear surface. The balls are independently and separately mounted so that the resistance to abrasion of the cutting surface can be varied as desired to provide an optimum crushing surface for a particular material or operation.

None of the prior art patents discussed above disclose the combination of protruding inserts and a manganese wear liner in a jaw or cone crusher. Moreover, none of these patents discuss cubicity.

What is needed therefore are a method and apparatus which add life to the crushing surfaces of a crusher, which increase the cubicity of the crushed material, and which increase the efficiency of the crusher.

SUMMARY OF THE INVENTION

One aspect of the present invention is to provide a rock crusher having hardened inserts that are mounted in cavities formed in the crushing surface of a wear liner thereof and that extend from the crushing surface and towards the crushing surface of an opposed crushing element. The inserts impact the rock so as to crush the rock by shattering rather than by compression and hence improve the crusher's operation.

The hardened inserts exhibit a greater resistance to wear and to impact than hardened steel and preferably are formed from a wear resistant and impact resistant tungsten carbide cobalt such as 2M12 grade tungsten carbide/cobalt. The inserts increase the life of the liner substantially while unexpectedly and dramatically improving the gradation and cubicity of the product. The inserts also increase the crusher's capacity while reducing its power requirements. Moreover (and unexpectedly), the inserts retain their superior crushing characteristics for the life of the liner.

The inserts are preferably provided in the liner(s) of either a cone crusher or a jaw crusher and are arranged in a pattern having a configuration and density designed to optimize the desired crushing effect. For instance, in the case of cone crushers, the inserts are provided in at least two (and preferably three or more) concentric circular rows extending around a lower peripheral portion of the crushing head such that the inserts of each row are spaced from one another by about 1.25" and such that the rows of inserts are spaced from one another by about 1.25". In the case of jaw crushers, the inserts are arranged in straight rows extending from the upper end of the wear liner to the lower end such that the inserts of each row are spaced non-uniformly, with the spacing between inserts being smaller near the ends of the liner than near a central portion of the liner.

The shape of each insert is preferably selected to strike a balance between its crushing ability and its wear resistance. Preferably, the tip of each insert has 1) an inner, essentially linearly-tapered portion having generally the shape of a truncated elliptic cone and 2) an outer portion having generally the shape of an elliptic paraboloid.

Another object of the invention is to provide a method of manufacturing a wear liner for a rock crusher. Manufacturing is complicated by the fact that heat-treated manganese is nearly impossible to drill. The invention avoids the need to drill manganese by casting the cavities in the manganese wear liner during the liner's fabrication and mounting the inserts in the cavities of finished wear liner. It has been found, unexpectedly, that relatively tight tolerances in cavity diameter can be maintained during the manganese casting and heat treating process so that an insert can be press-fit into the cavity of the finished liner, thereby significantly facilitating insert mounting.

Yet another object of the invention is to provide an improved method of crushing rock.

This object is achieved by crushing the rock in a crusher such as a cone crusher or jaw crusher by fracturing the rock via impact with inserts mounted in a crushing surface of at least one of the crushing elements of the crusher. The inserts have tips which extend outwardly from the crushing surface so as to fracture rock upon impact therewith. Crushed rock produced by a crusher using these inserts exhibits extremely uniform gradation and extremely high cubicity. Moreover, the crushing process requires substantially less power and exhibits much improved capacity compared to corresponding processes performed by standard crushers lacking inserts.

Other objects, features, and advantages of the invention will become more apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Pursuant to a preferred embodiment of the invention, a rock crusher such as a one or jaw crusher incorporates hardened tapered inserts in the manganese or other wear liner of at least one of its crushing elements. The inserts extend outwardly from the crushing surface of the crushing element towards the facing crushing surface so as, in use, to act as pick axes that shatter rock primarily by impact rather than pulverizing the rock by compression. The inserts are fixed in a heat treated manganese wear liner either by bonding or by press-fitting. The inserts substantially improve the life of the wear liner and, unexpectedly, 1) produce product of a highly uniform gradation in the desired ranges, 2) consistently produce product with a very high cubicity, 3) dramatically reduce the crusher's power requirements, and 4) significantly increase the crusher's capacity.

2. Construction of Crushers Incorporating Bonded Inserts

Figure 1:
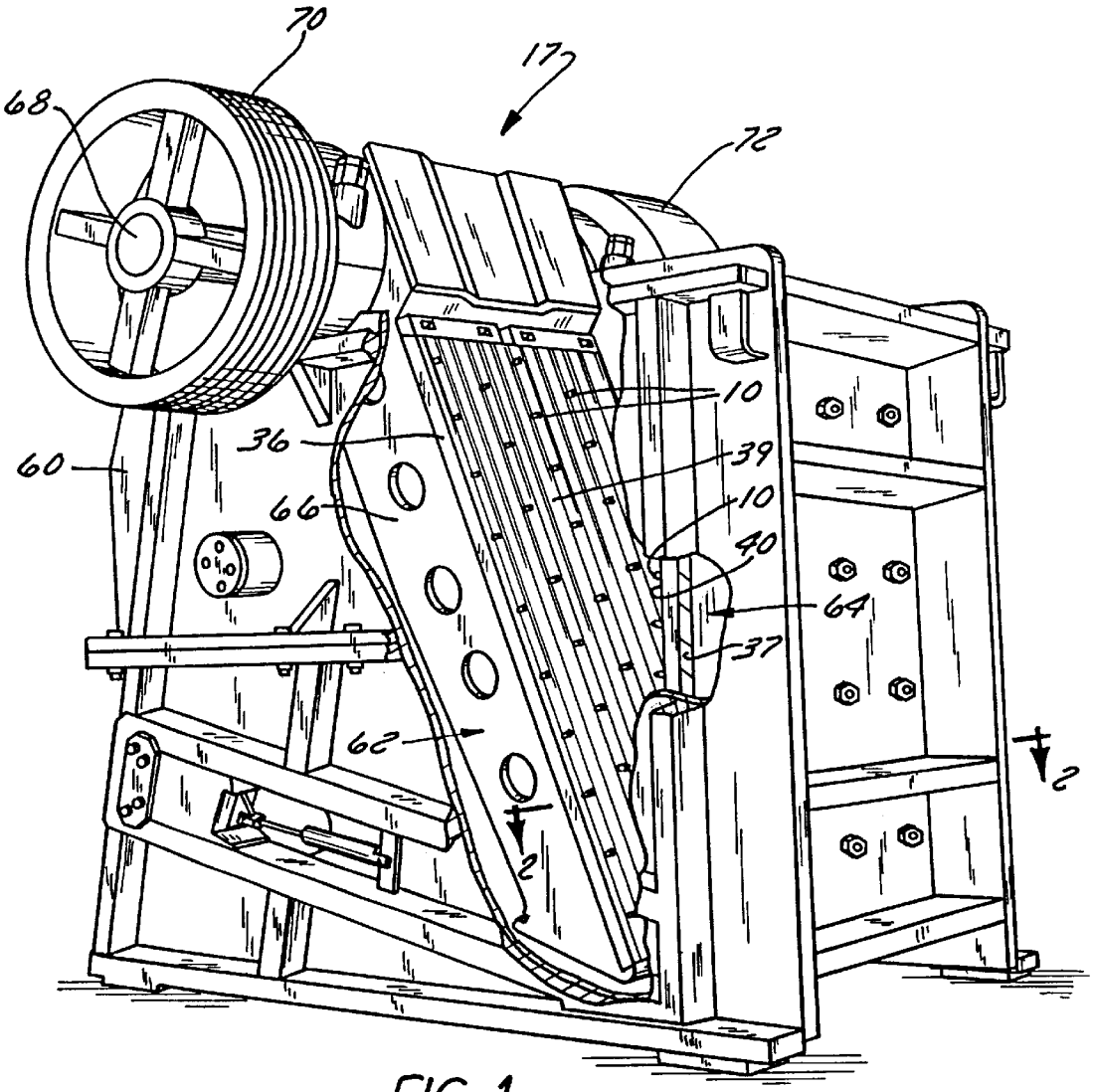
FIG. 1 is a perspective view of a jaw crusher with parts broken away to show the crusher's dies and inserts constructed in accordance with a first embodiment of the invention.
Figure 2:
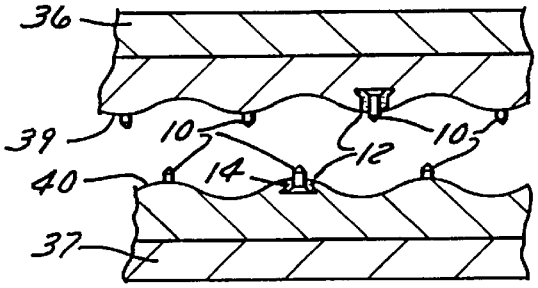
FIG. 2 is an enlarged fragmentary cross sectional view of the dies and inserts of the jaw crusher of FIG. 1, taken generally along the line 2—2 of FIG. 1.
Figure 3:
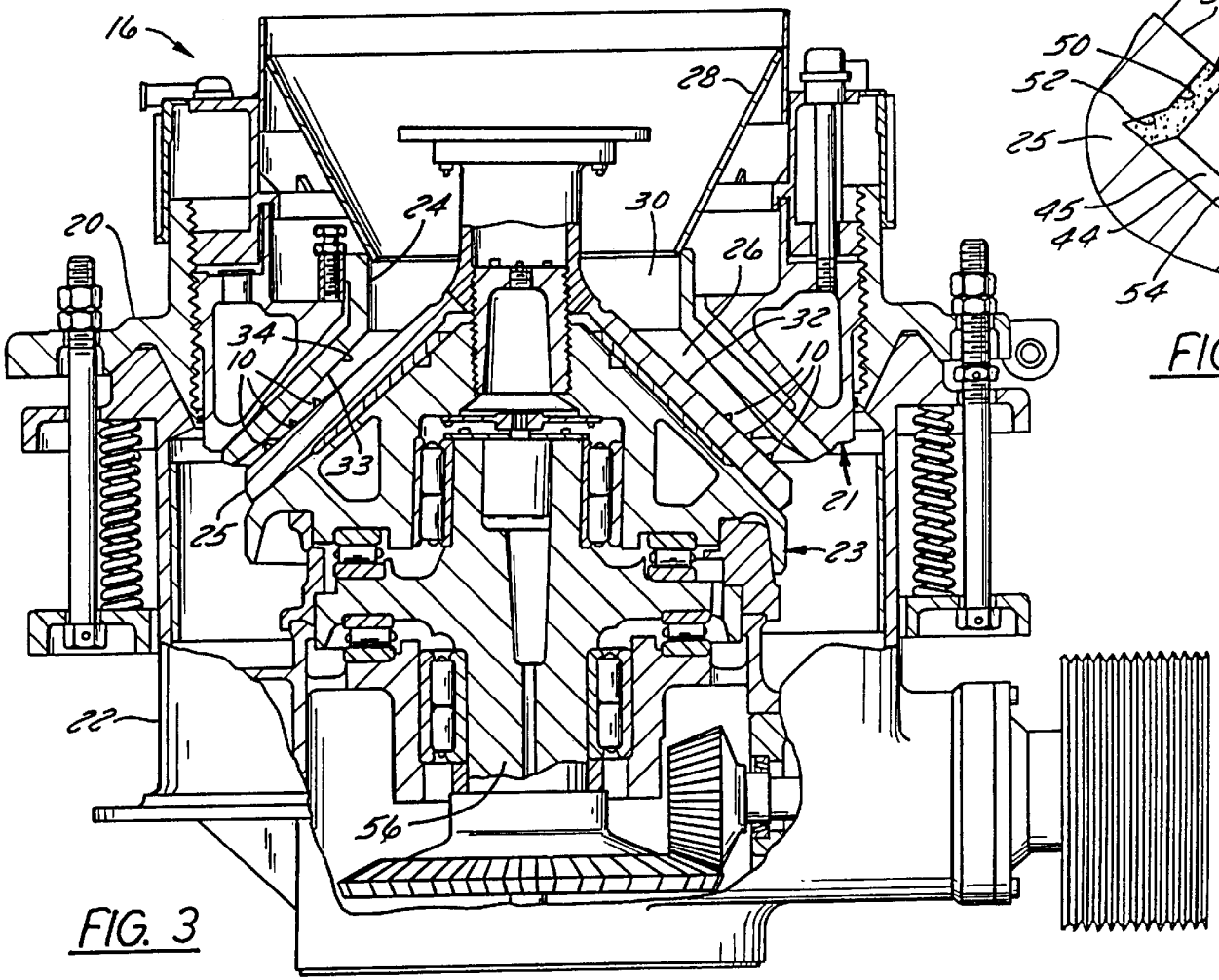
FIG. 3 is a sectional elevation view of a cone rock crusher employing inserts constructed in accordance with the first embodiment of the invention.
Figure 4:
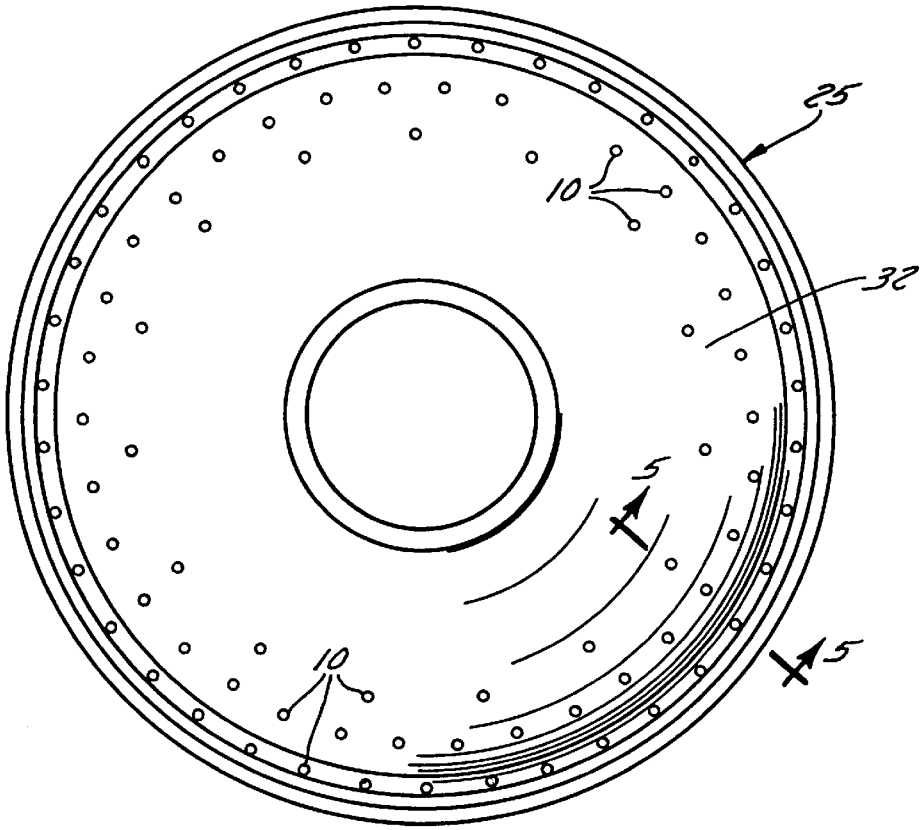
FIG. 4 is a top plan view of a head of the cone rock crusher of FIG. 3.
Figure 5:
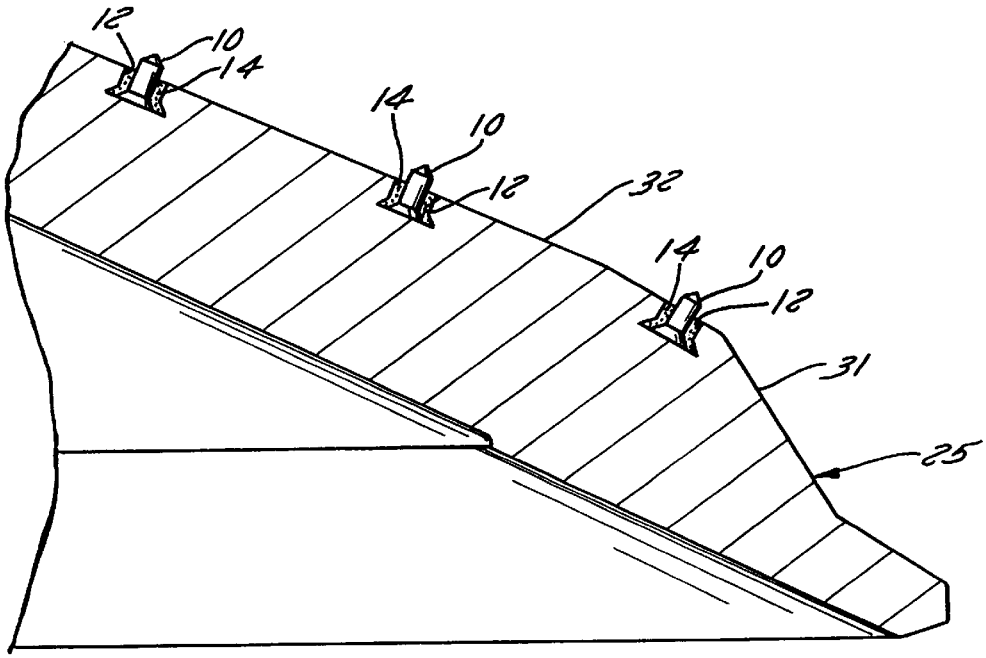
FIG. 5 is an enlarged fragmentary sectional elevation view of the head of the cone rock crusher of FIG. 4, taken along the line 5—5 in FIG. 4.
Figure 7:
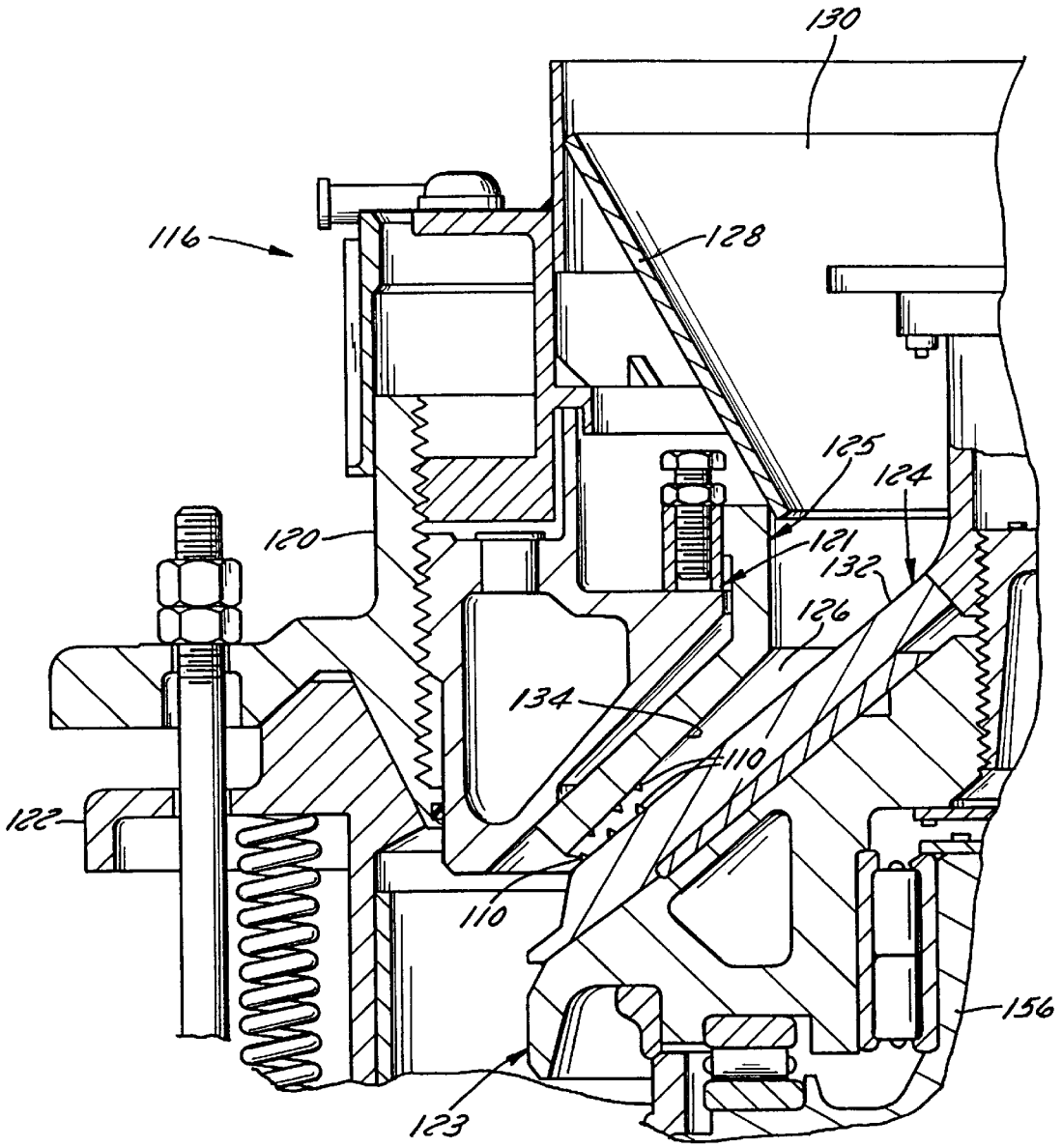
FIG. 7 is a fragmentary sectional elevation view of a portion of a cone crusher employing inserts constructed in accordance with a second embodiment of the invention.
Figure 8:
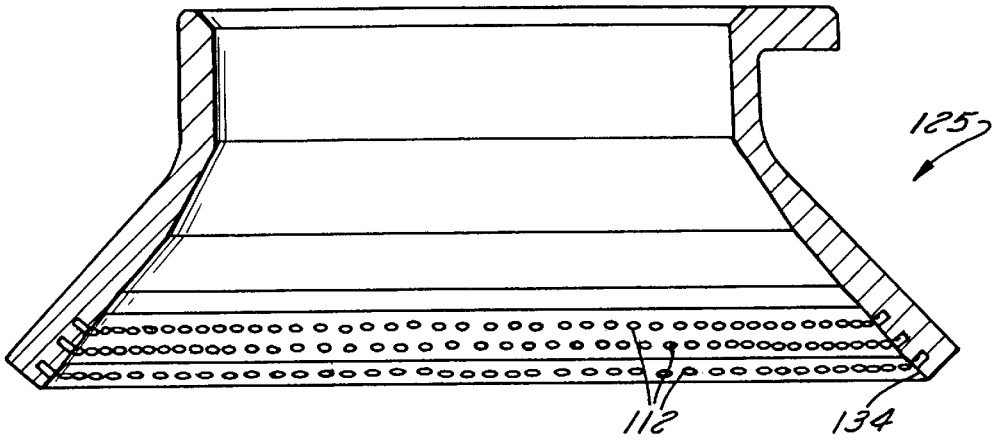
FIG. 8 is a sectional elevation view of a bowl of the crusher of FIG. 7.
Figure 9:
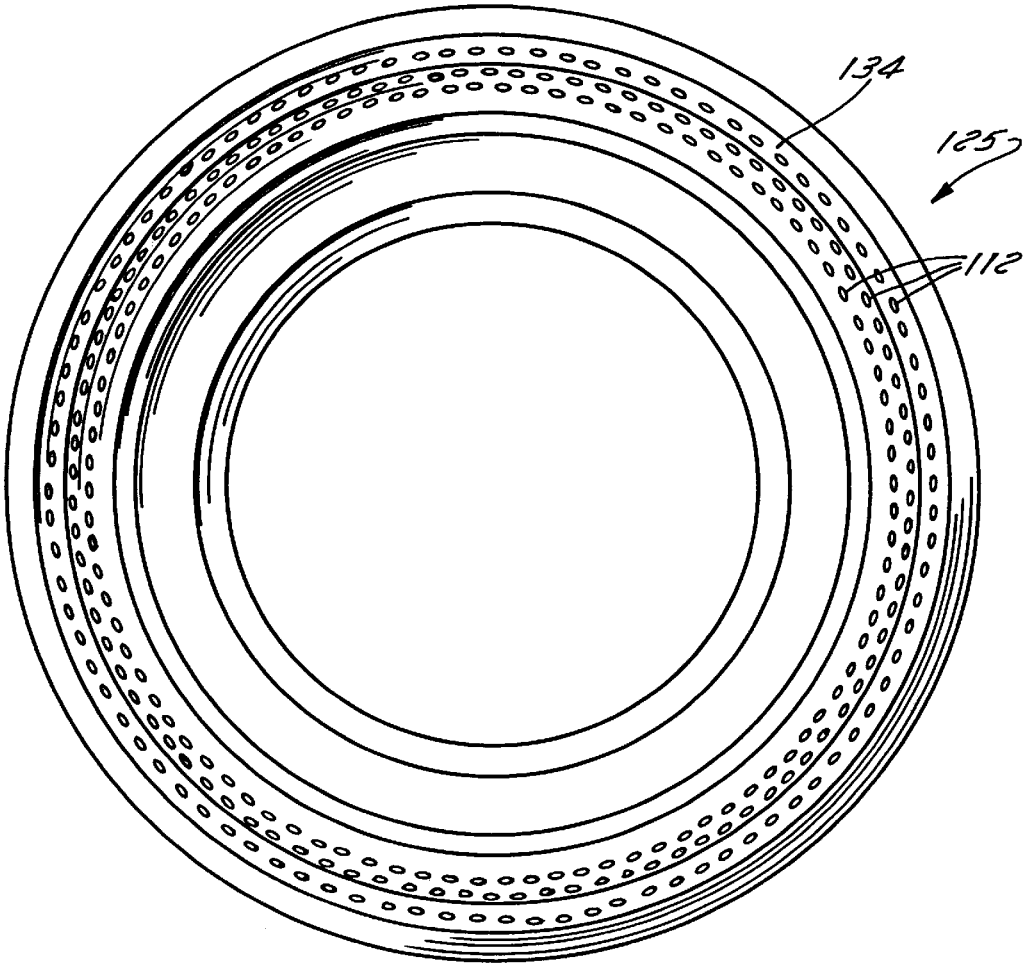
FIG. 9 is a top plan view of the bowl of FIGS. 7 and 8.
Figure 10:
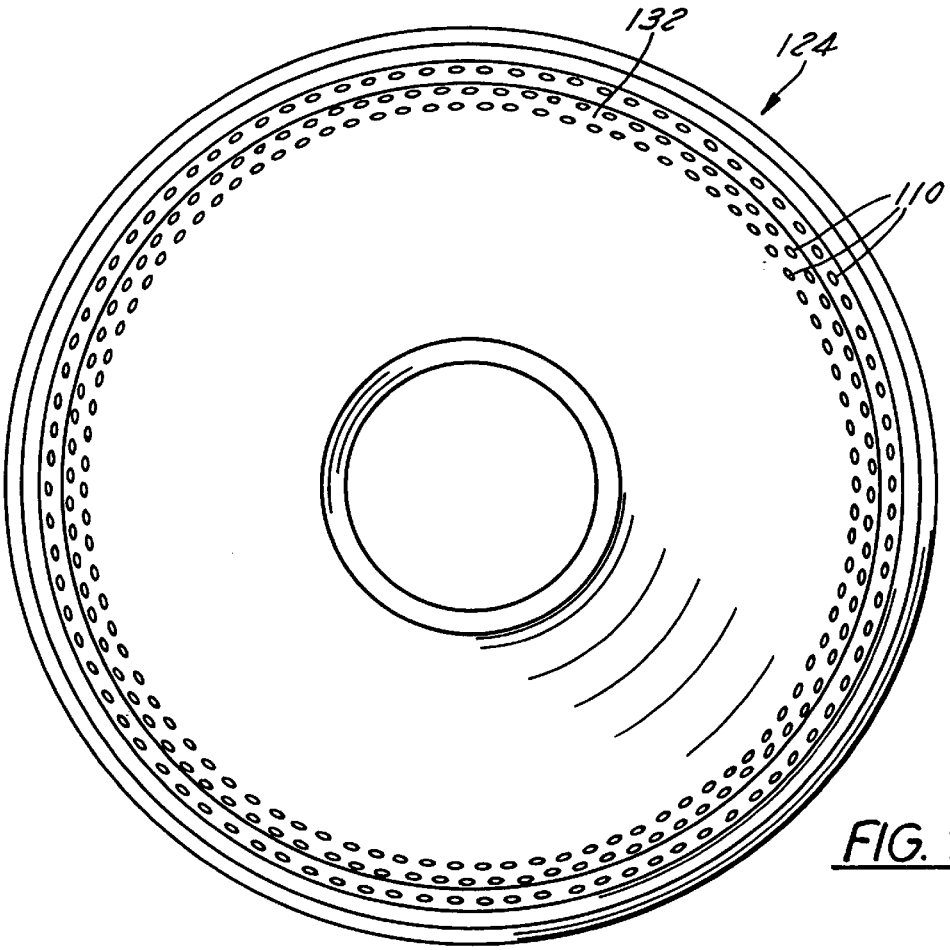
FIG. 10 is a top plan view of the head of the crusher of FIG. 7.
Figure 13:
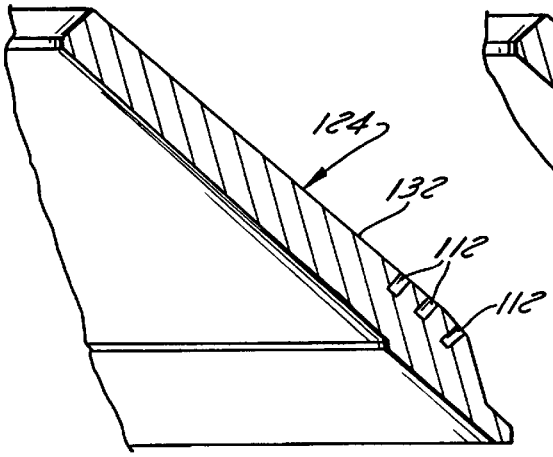
FIG. 13 is an enlarged fragmentary sectional elevation view of the liner of the bowl of FIG. 10 without inserts.
Figure 14:
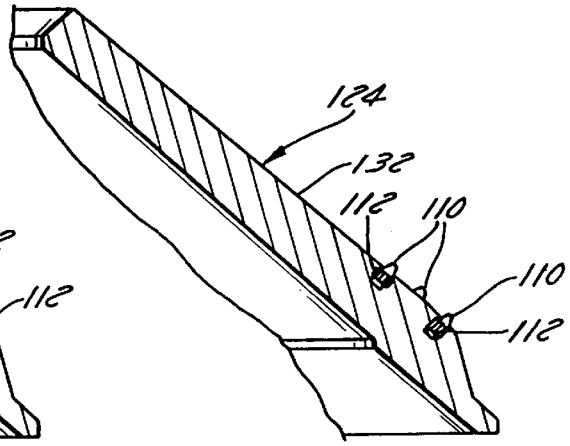
FIG. 14 is an enlarged fragmentary sectional elevation view of the liner of FIG. 13, with inserts.
Figure 11:
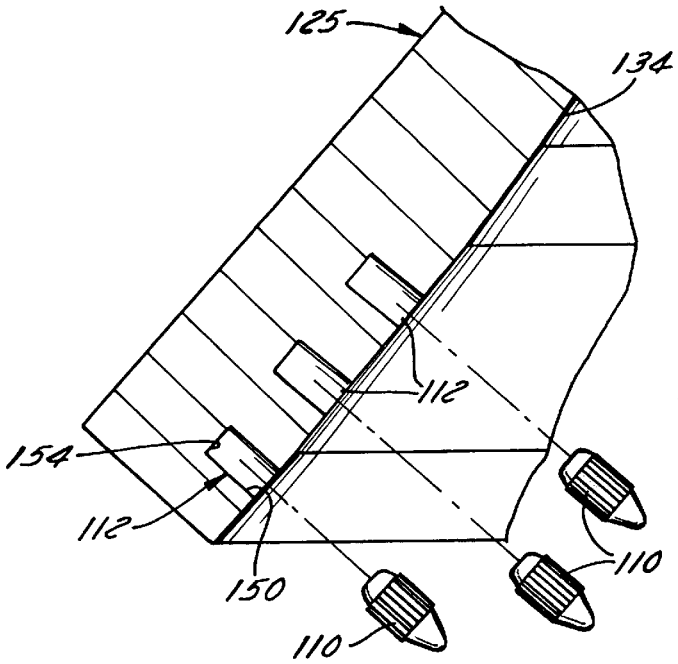
FIGS. 11 and 12 are enlarged fragmentary sectional elevation view of a portion of a liner/insert assembly of the bowl of FIGS. 8 and 9, illustrating the assembly in an exploded view and a perspective view, respectively.

Referring more particularly to FIGS. 1–6, wherein like numbers refer to like parts, a first embodiment of the present invention is illustrated in which inserts 10 are held in receiving cavities 12 of a wear liner by a bonding agent 14. The inserts 10 of this embodiment are well-suited for use in any rock crushing machines having opposed crushing elements. For simplicity, the description below will focus on the inserts 10 as they are made and used in a 1) a jaw crusher 17 (FIGS. 1 and 2) and 2) a cone crusher 16 (FIGS. 3–5).

The cone crusher or gyratory crusher 16, as shown in FIG. 3, includes an upper frame assembly 20 and a stationary lower frame assembly 22 which, in combination, enclose a gyrating conical head 23 mounted on an eccentric shaft 56. The upper frame assembly 20 includes 1) a bowl 21 surrounding the conical head 23 and 2) a hopper 28 that is disposed above the bowl 21 and that has a central opening 30 which allows the entry of the rock to be crushed. A mantle, formed from a manganese wear liner 24, is detachably mounted on the underlying base of the conical head 23 to present a crushing surface 32. A similar wear liner 25 covers the bowl 21 to present a mating, upper crushing surface 34. A crushing chamber 26 is formed between the crushing surfaces 32 and 34. This crushing chamber 26 is non-annular due to the eccentric positioning of the crushing head 23 within the bowl 21. The minimum width of the crushing chamber 26 (i.e., the minimum gap or spacing between the conical head 23 and the bowl 21) is known as the "closed side setting" and typically varies in diameter from about_" up to about 1" or even wider.

Inserts 10 are mounted in either or both of the opposed crushing surfaces 32, 34 and protrude therefrom so as to extend towards the opposed crushing surface. The inserts 10 can be mounted in any of several patterns which cover the upper crushing surface 34 on the cone crusher's bowl liner 24, the lower crushing surface 32 on the cone crusher's mantle or head liner 25, or a portion or all of the surface of both. One such pattern is illustrated in FIG. 4 and is formed by three concentric circular rings of evenly-spaced inserts 10.

The jaw crusher 17, as shown in FIGS. 1 and 2, includes a housing 60, a swinging jaw assembly 62 mounted in the housing 60, and a stationary jaw assembly 64 mounted in the housing 60. Dies 36, 37 are mounted on facing surfaces of the jaw assemblies 62, 64, respectively. Each die 36, 37 receives a replaceable manganese wear liner 39, 40 having a corrugated crushing surface. The swinging jaw assembly 62 incorporates a pitman 66 mounted on the housing 60 by way of an eccentric shaft 68. A driving sheave 70 and a flywheel 72 are mounted on opposite ends of the shaft 68 such that, when a rotational force is imparted to the sheave 70 by a belt (not shown), the swinging jaw assembly 62 swings cyclically towards and away from the stationary jaw assembly 64 to crush rock between the facing dies 36, 37.

Inserts 10 are mounted in the crushing surface of one or both of the wear liners 39, 40 so as to extend towards the crushing surface of the opposed wear liner. The inserts 10 can be arranged in various patterns on the liner 39 or 40 of one or both of two opposed dies 36, 37. In the illustrated embodiment, the inserts 10 are arranged in straight rows extending along the peaks of the liner's corrugations.

The same inserts 10 are used in the wear liner(s) of both the cone crusher 16 and the jaw crusher 17. The inserts 10 also operate identically in both crushers 16 and 17. Accordingly, the inserts 10 will be detailed only with respect to the cone crusher 16, it being understood that the discussion applies equally to the jaw crusher 17.

The inserts 10 are made from a material having greater wear and impact resistance than hardened steel. The preferred material is a hard tungsten carbide material incorporating cobalt to increase its impact resistance. The preferred material grade is known as a 2M12 tungsten carbide/cobalt having 10.5% by weight cobalt. It is believed that 2M1 or 2M11 product grades (having 9.5% and 11% cobalt, respectively) also would work acceptably. It is also believed that materials having a grade designation of RX007 or lower would lack the desired impact resistance, while materials having a grade designation of 2M13 or higher would lack the desired wear resistance. It should also be noted that the inserts could be made from another suitably hard, impact resistant, and wear-resistant material and that, even in the case of a tungsten carbide insert, another low-stacking fault energy metal such as nickel or chromium may be used in place of or in addition to the cobalt.

Figure 6:
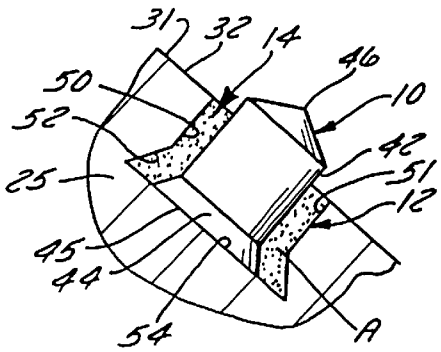
FIG. 6 is an enlarged fragmentary sectional view of an insert protruding from the wear liner of the conical head shown in FIGS. 4 and 5.

In the embodiment illustrated in FIGS. 1–6, the carbide inserts 10 have 1) a generally cylindrical body 42 having a generally cylindrical flange 44 and an inner end 45, and 2) an outer tip 46. The flange 44 is wider than the remainder of the body 42 as best shown in FIG. 6. Alternatively, the body 42 of the insert 10 may be any of several shapes, including polyhedronal, frusto-conical, egg-shaped, or wedge-shaped. The terms "flange" and "flanged" therefore are used to describe the spreading or expanding out of the body of the insert and the side wall of the cavity so that the flange 44 and flanged portion 52 have a greater cross sectional area than the adjacent areas of the cavity and insert. The tip 46 is generally frusto-conical in shape, extends from the end of the insert body 42, and protrudes about 0.25" beyond the crushing surface 32, 34 to form an impact point.

The cavity 12 has a shape generally corresponding to that of the carbide insert 10. Accordingly, as seen in the embodiment shown in FIG. 6, the cavity 12 has a peripheral side wall 50 and terminates in an inner end wall 54. The side wall 50 has a generally cylindrical outer portion 51 and a flanged inner portion 52 which expands radially outwardly to generally compliment the shape of the flange 44 on the insert 10. The inner end 45 of the insert 10 preferably abuts the inner wall 54 of the cavity 12.

The diameter of the flange 44 on the insert 10 is roughly equal to the diameter of the outer portion 51 of the cavity 12 so that the insert 10 can be placed in the cavity 12 with a slight radial clearance. The body 51 and the flanged portion 52 both have diameters larger than the diameters of the body 42 and flange 44 of the insert 10 such that, in use, a generally annular space is formed between the circumferential surfaces of the insert 10 and the facing peripheral surface 50 of the cavity 12. A bonding agent 14, such as an epoxy, fills this space to hold the insert 10 in the cavity 12. The volume of this space should be minimized as much as possible while still permitting insertion of the flanged insert 10 into the cavity 12 in order to maximize the strength of the bond formed by the agent 14.

The inserts 10 cannot be cast into place in the manganese liners 25 prior to heat treating because the hard inserts 10 would shatter during the heat treating and quenching operation of the manganese. Moreover, it is difficult or impossible to drill holes in a heat treated manganese liner. These problems are eliminated in the present embodiment by bonding the inserts 10 in the cavities 12 of a finished liner. Specifically, after the wear liner has been cast with the cavities 12 in it, heat treated, and cooled, the inserts 10 are placed in the cavities 12 and held in position while a bonding agent 14 is injected into the cavities 12 to fill the spaces between the inserts 10 and the peripheral surfaces of the cavities 12. Alternatively, the bonding agent 14 may be injected into the cavities 12, and the inserts 10 then may be placed in the cavities 12, preferably abutting the inner walls 54 of the cavities 12. The insert's flange 44 and the flanged portion 52 of the side wall 50 of the corresponding cavity 12 serve to keep the insert 10 securely fastened in the wear liner by ensuring that the bonding agent 14 works in compression in the space "A" between the flange 44 of the insert 10 and the flanged portion 52 of the cavity 12 after it hardens.

The preferred bonding agent is a two-part epoxy known as "SMITHBOND®" and produced by Telsmith, Inc. of Mequon, Wis. However, one can imagine several other bonding agents which have a high compressive strength suitable for fastening the inserts 10 in the cavities 12.

3. Construction of Crushers Incorporating Press-Fit Inserts

As discussed above, tungsten carbide/cobalt inserts cannot as a practical matter be mounted in a manganese liner prior to heat treating because the inserts would shatter during the heat treating process. Moreover, cavities suitable for receiving inserts cannot be drilled into heat treated manganese liners because the heat treated manganese is too hard. However, it has been discovered that an insert can be press-fit into a preformed cavity of a manganese liner if 1) the cavities are cast into the liner with a relatively high degree of precision, and 2) the insert is fluted or otherwise shaped to dig into the peripheral sidewalls of the cavity. Referring to FIGS. 7–19, a cone crusher and a jaw crusher now will be described incorporating press-fit inserts 110.

Referring initially to FIGS. 7–14, a portion of a cone crusher 116 is illustrated which is identical to the cone crusher 16 of the first embodiment except that the inserts 110 are of a different configuration and are arranged in a different pattern than inserts 10 of FIGS. 1–6. Components of the crusher 116 that correspond to components of the crusher 16 of the first embodiment are designated by the same reference numerals, incremented by 100.

The crusher 116 comprises an upper frame assembly 120 and a lower frame assembly 122 which, in combination, enclose a gyratory conical head 123 mounted on an eccentric shaft 156 in the conventional manner. The upper frame assembly 120 includes 1) an upper hopper 128 having a central opening 130 and 2) a lower bowl 121 that surrounds and opposes the conical head 123. A mantle, formed from a manganese wear liner 124, is detachably mounted on the underlying base of the conical head 123 to present a lower crushing surface 132. A similar wear liner 125 covers the bowl 121 to present a mating, upper crushing surface 134. A non-annular crushing chamber 126 having an adjustable closed side setting is formed between the crushing surfaces 132 and 134.

The inserts 110 can be mounted in either or both of the crusher's opposing crushing surfaces 132, 134 so as to extend from the crushing surface 132 or 134 and towards the opposed crushing surface 134 or 132. In the illustrated embodiment, inserts 110 are provided in both crushing surfaces 132 and 134 in a pattern designed so as to achieve a desired crushing effect. The illustrated pattern takes the form of three concentric circular rings of evenly-spaced inserts 110 located adjacent the bottom of the corresponding wear liner 124 or 125. Inserts of each row are spaced about 1.25" apart, and each row is spaced about 1.25" from the adjacent row. The pattern of the illustrated embodiment is designed to produce a high percentage of relatively small gravel or coarse fines. This pattern could and preferably would change depending upon the results sought. For instance, a looser pattern (i.e., one in which the inserts are more widely spaced) could be employed to produce higher percentages of larger rock. Rows of inserts could also be mounted near the middle or top of the crushing chamber 126 instead of or in addition to one or more of the illustrated rows.

Figure 19:
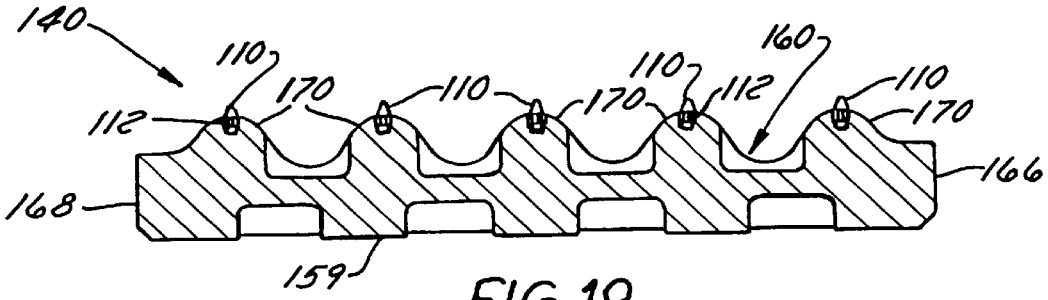
FIG. 19 is a sectional end elevation view taken along the lines 19—19 in FIG. 18.
Figure 18:
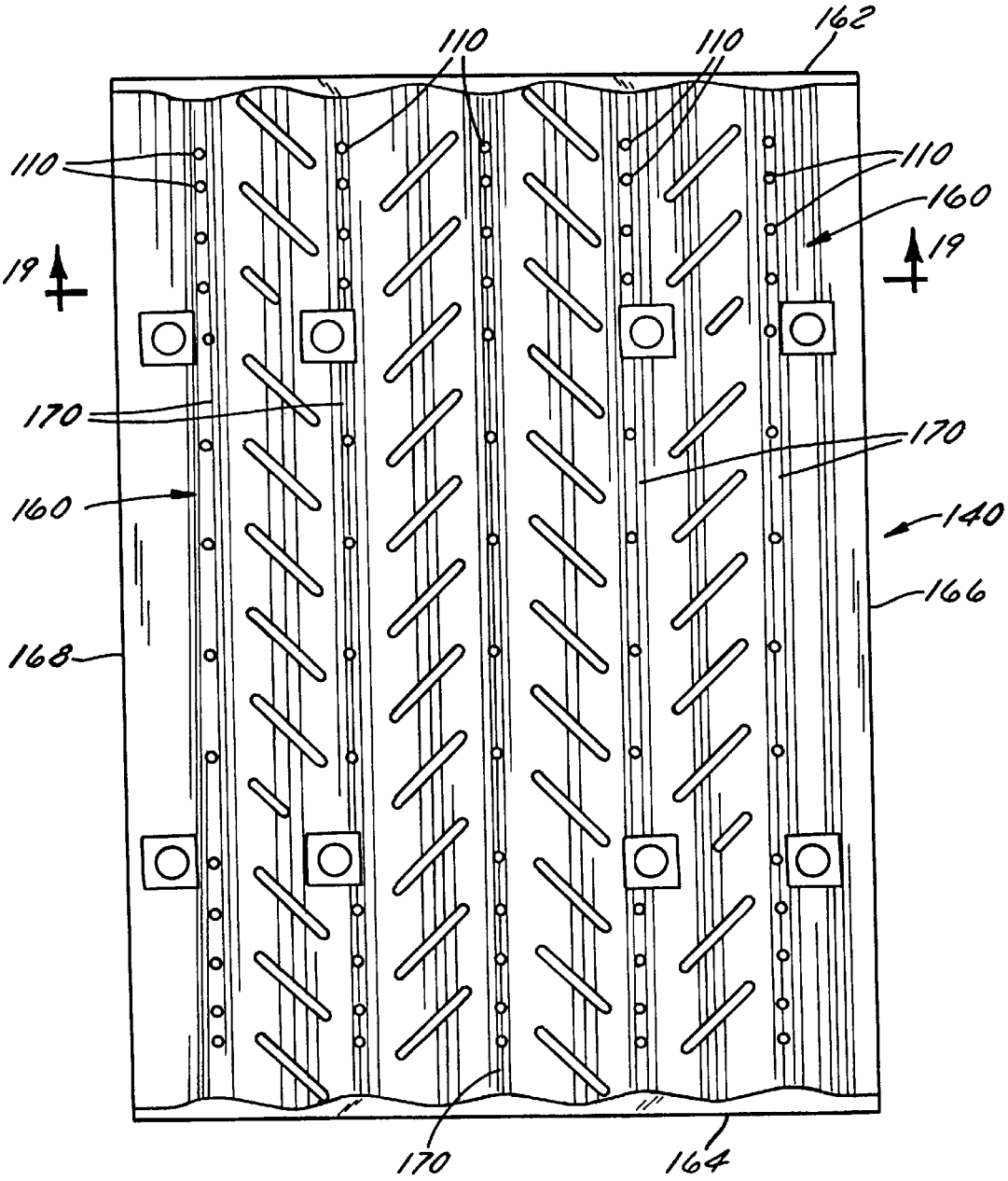
FIG. 18 is a top plan view of a wear liner of a jaw crusher employing inserts constructed in accordance with the second embodiment of the invention.

In the case of a jaw crusher, the inserts 110 can be arranged in various patterns on one or both of the crusher's opposed wear liners. A wear liner 140 suitable for mounting on a die 36 or 37 of the jaw crusher 17 of FIGS. 1 and 2 is illustrated in FIGS. 18 and 19. The wear liner 140 has an inner face 159 configured for mounting on the die 36 or 37 and an outer, corrugated face forming the crushing surface 160. The wear liner 140 is generally rectangular (hence matching the shape of the die 36 or 37) and hence has an upper end 162, a lower end 164, and opposed side edges 166 and 168. The inserts 110 are mounted on the crushing surface 160 of the wear liner 140—preferably at the peaks 170 of the corrugations as illustrated. In the illustrated embodiment, the inserts 110 are arranged in straight rows extending from the upper end 162 of the wear liner 140 to the lower end 164. The inserts 110 of each row are spaced non-uniformly so that the spacing between inserts is smaller near the ends of the wear liner 140 than near a central portion so that the spacing is at a minimum where the crushing action is at a maximum. In the illustrated embodiment in which the wear liner 140 has a length of 70", the inserts 110 of each row are spaced as follows: 1) the distance from the first, bottom insert to the second insert is 2"; 2) the distance between each of the second and third, third and fourth, and fourth and fifth inserts is 3"; and 3) the distance between each of the fifth and sixth and sixth and seventh inserts is 6". This pattern is repeated at the opposite or upper end of the liner 140.

The same inserts 110 are used in the wear liner(s) 124 and 125 of the cone crusher 16 and the wear liner 140 of the jaw crusher 17. The inserts 110 also operate identically in both types of wear liner. Accordingly, the inserts 110 will be detailed only with respect to the wear liners 124 or 125 for the cone crusher 116, it being understood that the discussion applies equally to the wear liner 140 for the jaw crusher 17.

The inserts 110, which are made from the same tungsten carbide/cobalt material as the inserts 10 described above, are designed to be press-fit into cavities 112 so that their tips extend outwardly away from the crushing surface of the wear liner 124 or 125. Towards these ends, the inserts 110 assume a fluted, generally cylindrical shape having a tapered tip. More specifically, each insert 110 has a generally cylindrical body 142 disposed within the cavity 112 and an outer tip 146 extending outwardly from the liner's crushing surface as seen particularly in FIGS. 15–17. The cavity 112 and insert body 142 each have a length of about 1". However, it maybe desirable to provide a deeper cavity and correspondingly longer insert so as to increase the effective life of the insert as the insert and the manganese liner wear. Increasing the depth of the cavity to 2" or even 2.5" with a commensurate increase in the length of the insert would not be out of the question.

The major portion of the body 142 (excluding the inner end 145) is fluted to present serrations that facilitate press-fitting. Press fitting is possible due in part to the fact that is has been discovered that the cavities 112 can be cast into manganese liners and that the manganese can be heat treated such that the cavities maintain their dimensions with a relatively tight tolerance after the heat treating and subsequent cooling processes. Nevertheless, it is impossible to hold these tolerances perfectly during liner manufacturing. The provision of the serrations on the body 142 facilitates the accommodation some variations in cavity diameter. In the illustrated embodiment in which the cavity 112 is cylindrical and is about 0.550" wide (with a tolerance of about 0.005"), the body 142 has a major diameter M of essentially 0.590", a root diameter R of essentially 0.530", and a pitch diameter P of essentially 0.564" (see FIG. 17). Enough serrations should be incorporated in the body 142 to provide sufficient contact area to hold the insert 110 in place within the cavity 112 after press-fitting. Sixteen serrations are provided in the illustrated embodiment.

Figure 15:
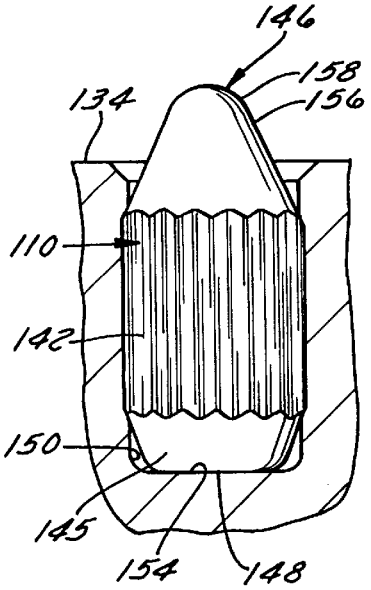
FIG. 15 is an enlarged fragmentary sectional elevation view of a portion of the liner of FIGS. 13 and 14, illustrating an insert in the liner.
Figure 16:
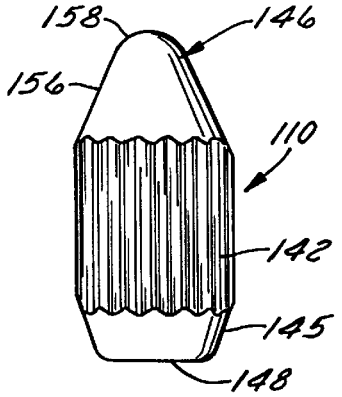
FIG. 16 is an elevation view of the insert of FIG. 15.
Figure 12:
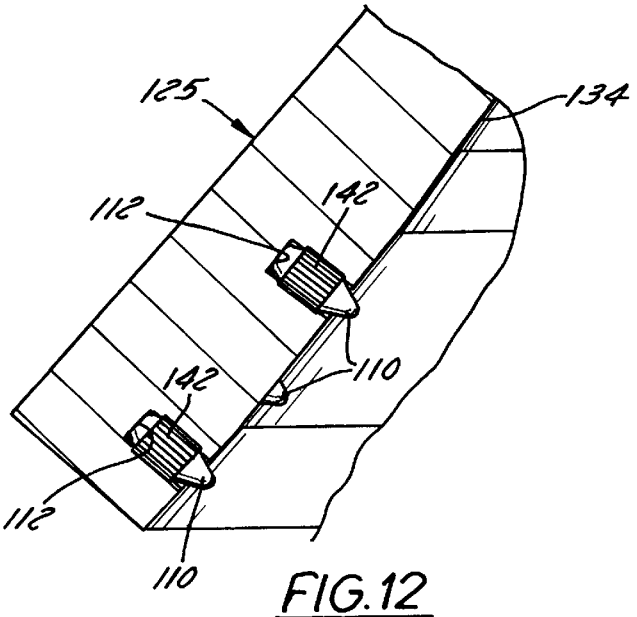
Figure 17:
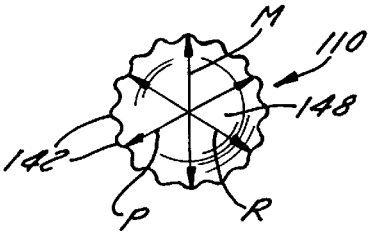
FIG. 17 is a top plan view of the insert of FIG. 16.

The inner end 145 of the body 142 is tapered downwardly and inwardly so as to facilitate insertion of the insert 110 into the corresponding recess 112 during the fabrication process. The inner or bottom surface 148 of the insert 110 should be flat so that, after the press fitting operation, the inner surface 148 rests firmly on the inner end 154 of the cavity 112 as best seen in FIG. 15.

While the insert 110 is designed to resist wear by abrasion so as to increase the overall life of the liner in which it is mounted, it is also designed to act in use like a pick-axe that shatters rock by impact with it as opposed to merely crushing the rock by compression. Were it not for this intended shattering effect, the tip 146 could be squared off or even eliminated altogether. However, in order to take advantage of the impact effect, the tip 146 is provided with a tapered profile that is designed to strike an acceptable balance between impact efficiency and wear resistance. The illustrated tip 146 extends about 0.25" beyond the crushing surface 132 or 134 of the wear liner 124 or 125 and includes 1) an inner, essentially linearly-tapered portion 156 having generally the shape of a truncated elliptic cone and 2) an outer portion 158 having generally the shape of an elliptic paraboloid.

The manner in which a liner/insert assembly is fabricated will now be detailed with respect to the cone crusher 116, it being understood that virtually the identical operation would be used to mount inserts 110 in the cavities 112 of the liner 140 of a jaw crusher.

First, the liner 124 or 125 is cast and then heat treated with the cavities 112 formed in it. As mentioned above, it has been discovered that the cavities can be formed with a relatively high degree of uniformity so that the cavities of the finished liner have a generally uniform diameter (within an acceptable tolerance) and a generally uniform depth. The inserts 110 are then set into the cavities 112 manually so that the tapered ends 145 rest in the openings of the cavities 112. The inserts 110 are then press-fit into the cavities 112 one at a time using a hydraulic ram that can be moved around the periphery of the liner 124 or 125. During the pressing operation, the flutes or serrations on each insert body 142 dig into the peripheral wall 150 of the corresponding cavity 112 so that the insert 110 is held firmly in place within the cavity 112. The resultant retention forces are very high. Tests have shown that few if any inserts 110 fall out of the liner 124 or 125 during crushing until the liner has worn to the extent that the cavities 112 are entirely or nearly entirely worn away.

4. Operation of Crusher

The basic operation of the cone crushers 16, 116 is identical and is not affected by the mounting technique for the insert 10 or 110. That is, material falling into the crushing chamber 26 or 126 is crushed by the cooperation of the inserts 10 or 110 on the liner 125 of the gyrating head 123 and the mating crushing surface of the bowl liner 24, 124. The addition of the inserts 10, 110 extends the "point of contact" of the crushing surfaces 32, 34; 132, 134 outwardly so that the compression forces of the crushing surface are concentrated on the protruding tips 46, 146 which directly engage the rock. The inserts 10, 110 thus allow the enhanced crushing surfaces 32, 34; 132, 134 to provide an impact crushing action which shatters the rock (much like the action which occurs upon impact with a pick axe) rather than pulverizing the rock by compression. This shattering action increases the crusher's crushing efficiency and reduces the amount of undesirable "fines" (material of extremely small size) typically produced by crushing surfaces of conventional rock crushers. Similar beneficial effects are achieved during operation of a jaw crusher 17 employing inserts 10 or 110.

Substantial testing of a cone crusher incorporating the inventive inserts has revealed several surprising and unexpected results. Similar results have been obtained during more limited testing of a jaw crusher. However, because more extensive testing has been performed to-date on cone crushers, these results and the unexpectedness thereof will be discussed in conjunction with a cone crusher.

5. Example: Testing of a Telsmith Model 52FC Gyrasphere Crusher

Field tests of a Telsmith Model 52FC or cone crusher were conducted both with and without inserts. This crusher included all of the basic components discussed above in conjunction with the crushers 16 and 116. During the tests conducted with inserts, the manganese liner of the bowl of this crusher contained inserts, while the liner of the mantle lacked inserts. The inserts were of the "press-fit" type discussed in Section 3 above and were arranged in the pattern discussed in that section. Tests were run at various close side settings both with and without inserts. Sandstone (a very abrasive substance) was crushed during all tests discussed below. Some of the results of these tests could be anticipated at least to some extent. Other results were wholly unexpected. These results will now be summarized.

a. Wear Life

As one might expect, the inserts significantly extended the life of the wear liners so that the time between liner changes was increased. In fact, on average, the life of the liners containing the inserts was increased by about 100%. This increase alone might not justify the costs of the inserts because the cost of a liner having inserts is currently about 3 times the cost of a liner lacking inserts. However, the manner in which this wear occurs was unexpected. More specifically, the manganese liner wore in valleys around the inserts so that the inserts continued to protrude from the crushing surface of the liner as the crushing surface wore. The "pick axe" effect of the inserts' crushing action therefore was retained as they wore. Indeed, and unexpectedly, the tips of the inserts retained their rounded or tapered profile as they wore so that the impact effect was retained with a high degree. Hence, the improved crushing capabilities (as detailed below) were retained essentially throughout the entire life of the wear liner.

b. Gradation

Gradation is an important consideration in crusher design. Gradation is defined by the percentage of a sample above or below a particular size, i.e., by the percentage of a sample passing through or being retained on a particular screen such as a 3/16" square cloth. An ideal crusher is one which consistently produces a high percentage of product material of a desired diameter range. The consistency of a crusher's operation can be monitored by comparing the gradation of incoming or feed product with the gradation of outgoing or crushed product. As one might expect, the gradation of crushed product varies with 1) the gradation of the raw or feed material fed to the crusher and 2) the closed side setting of the crusher.

During testing, the crusher was operated-both with and without inserts at a closed side setting of_(0.875) inches. A gradation analysis of a sample crushed with inserts in the liner is tabulated in Tables 1 and 2 in which Table 1 reflects the gradation analysis for the feed or raw material to the crusher and Table 2 reflects the gradation analysis for the product material, i.e., the crushed rock.

TABLE 1

Gradation Analysis of Feed Material (with inserts)

| Cloth Size | Weight (pounds) | At Size Percent Retained (%) | Cumulative Percent Retained (%) | Cumulative Percent Passing (%) |
|---|---|---|---|---|
| 8" | | 0% | 0% | 100% |
| 7" | | 0% | 0% | 100% |
| 6" | | 0% | 0% | 100% |
| 5" | | 0% | 0% | 100% |
| 4½" | 1.93 | 3% | 3% | 97% |
| 4" | 3.91 | 7% | 10% | 90% |
| 3½" | 0.00 | 0% | 10% | 90% |
| 3" | 0.00 | 0% | 10% | 90% |

TABLE 1-continued

Gradation Analysis of Feed Material (with inserts)

| Cloth Size | Weight (pounds) | At Size Percent Retained (%) | Cumulative Percent Retained (%) | Cumulative Percent Passing (%) |
|---|---|---|---|---|
| 2½" | 4.71 | 8% | 19% | 81% |
| 2" | 2.06 | 4% | 22% | 78% |
| 1½" | 3.76 | 7% | 29% | 71% |
| 1¼" | 2.12 | 4% | 33% | 67% |
| 1" | 5.35 | 9% | 42% | 58% |
| ¾" | 9.37 | 17% | 59% | 41% |
| ½" | 14.55 | 26% | 84% | 16% |
| ⅜" | 6.38 | 11% | 95% | 5% |
| 3/16" | 0.89 | 2% | 97% | 3% |
| Pan | 1.66 | 3% | 100% | 0% |

Total = 56.67 Pounds 100%

TABLE 2

Gradation Analysis of Product Material (with inserts)

| Cloth Size | Weight (pounds) | Cumulative Percent Retained (%) | Cumulative Percent Passing (%) |
|---|---|---|---|
| 3½" | | 0% | 0% 100% |
| 3" | | 0% | 0% 100% |
| 2½" | | 0% | 0% 100% |
| 2" | | 0% | 0% 100% |
| 1½" | | 0% | 0% 100% |
| 1¼" | | 0% | 0% 100% |
| 1" | 3.02 | 5% | 5% 95% |
| ¾" | 7.07 | 11% | 15% 85% |
| ½" | 10.76 | 16% | 31% 69% |
| 3/82" | 6.03 | 9% | 41% 59% |
| 3/16" | 7.98 | 12% | 53% 47% |
| 8M | 4.56 | 7% | 59% 41% |
| 16M | 2.63 | 4% | 63% 37% |
| 30M | 3.15 | 5% | 68% 32% |
| 50M | 10.11 | 15% | 83% 17% |
| 100M | 8.77 | 13% | 97% 3% |
| 200M | 1.80 | 3% | 99% 1% |
| Pan | 0.48 | 1% | 100% 0% |

Total = 66.34 Pounds 100%

A gradation analysis for a sample produced by operation of the crusher without inserts is tabulated in Tables 3 and 4 in which Table 3 reflects the gradation analysis of the raw or feed material and Table 4 reflects the gradation analysis of the product material.

TABLE 3

Gradation Analysis of Feed Material (without inserts)

| Cloth Size | Weight (pounds) | At Size Percent Retained (%) | Cumulative Percent Retained (%) | Cumulative Percent Passing (%) |
|---|---|---|---|---|
| 8" | | 0% | 0% | 100% |
| 7" | | 0% | 0% | 100% |
| 6" | | 0% | 0% | 100% |
| 5" | 4.50 | 5% | 5% | 95% |
| 4½" | 1.52 | 2% | 7% | 93% |
| 4" | 0.87 | 1% | 8% | 92% |
| 3½" | 4.32 | 5% | 13% | 87% |
| 3" | 1.46 | 2% | 15% | 85% |
| 2½" | 4.14 | 5% | 19% | 81% |
| 2" | 3.68 | 4% | 23% | 77% |
| 1½" | 2.85 | 3% | 27% | 73% |
| 1¼" | 4.85 | 6% | 32% | 68% |

TABLE 3-continued

Gradation Analysis of Feed Material (without inserts)

| Cloth Size | Weight (pounds) | At Size Percent Retained (%) | Cumulative Percent Retained (%) | Cumulative Percent Passing (%) |
|---|---|---|---|---|
| 1" | 13.51 | 15% | 48% | 52% |
| ¾" | 14.37 | 16% | 64% | 36% |
| ½" | 19.55 | 22% | 87% | 13% |
| ⅜" | 7.75 | 9% | 95% | 5% |
| 3/16" | 1.26 | 1% | 97% | 3% |
| Pan | 2.71 | 3% | 100% | 0% |

Total = 87.33 Pounds 100%

TABLE 4

Gradation Analysis of Product Material (without inserts)

| Cloth Size | Weight (pounds) | At Size Percent Retained (%) | Cumulative Percent Retained (%) | Cumulative Percent Passing (%) |
|---|---|---|---|---|
| 3½" | | 0% | 0% | 100% |
| 3" | | 0% | 0% | 100% |
| 2½" | | 0% | 0% | 100% |
| 2" | | 0% | 0% | 100% |
| 1½" | 0.85 | 1% | 1% | 99% |
| 1¼" | 1.56 | 1% | 2% | 98% |
| 1" | 7.56 | 7% | 9% | 91% |
| ¾" | 20.34 | 18% | 27% | 73% |
| ½" | 23.63 | 21% | 48% | 52% |
| 3/82" | 11.85 | 10% | 58% | 42% |
| 3/16" | 17.75 | 16% | 74% | 26% |
| 8M | 8.99 | 8% | 82% | 18% |
| 16M | 3.98 | 4% | 85% | 15% |
| 30M | 2.99 | 3% | 88% | 12% |
| 50M | 4.98 | 4% | 92% | 8% |
| 100M | 5.83 | 5% | 97% | 3% |
| 200M | 2.15 | 2% | 99% | 1% |
| Pan | 0.73 | 1% | 100% | 0% |

Total = 113.21 Pounds 100%

Figure 20:
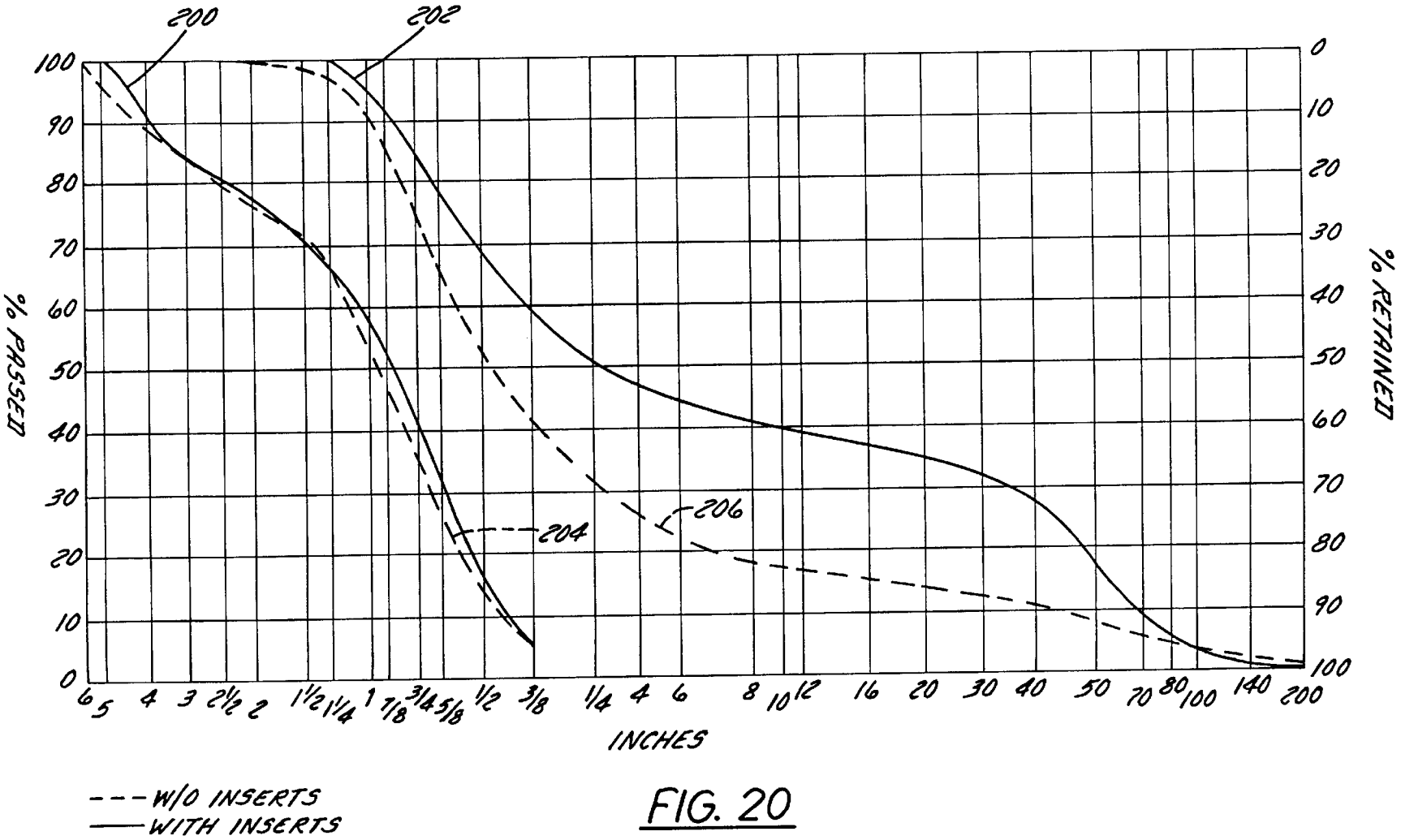
FIG. 20 is a graph showing gradation curves for crushers with and without inserts.

The data from Tables 1–4 is plotted graphically by the curves 200, 202, 204, and 206 of FIG. 20. These curves demonstrate that the results of these tests are dramatic and unexpected. Specifically, a comparison of the curves 200 to 204 in FIG. 20 illustrates that the gradation of the feed materials was essentially the same during both tests. However, the gradation of the product materials varied dramatically. The major portion of the curve 202 for the product material produced by crushing with inserts is much flatter (i.e., has a shallower negative slope) than the corresponding portion of the curve 206 for the product material produced by crushing without inserts. This flatness indicates that a very high percentage of the product is of a relatively uniform size. Moreover, a higher percentage of materials of a particular size is produced. For instance, a comparison of the curves 202 and 206 indicates that 47% of the crushed product passed through a 3/16" square cloth size when inserts were employed in the mantle liner of the crusher, whereas only 26% of the product passed through a mesh of the same sizes when nearly the identical feed materials were crushed in the same crusher lacking the inserts—an increase of 81%. This increase represents a dramatic, unexpected improvement for an operator who wishes to produce a high percentage of fine-diameter product (coarse fines).

The flatness or shallow negative slope of curve 202 leads one to believe that if the locations and/or pattern of the inserts 110 were to be varied, the curve 202 could be shifted upwardly or downwardly so as to achieve, with relatively high uniformity, a desired product of virtually any mesh size. This sort of control is impossible with standard manganese liners lacking inserts. Hence, curve 202 illustrates that adding the inserts to the liner not only produces more coarse fines but produces a greater percentage of coarse fines in a desired band.

c. Capacity and Power Consumption

As should be apparent from the gradation analysis above, it has been discovered that operation of a crusher with inserts at a particular closed side setting produces more coarse fines than operation of the same crusher at the same closed side setting without inserts. This discovery permits the operator of a crusher having inserts to provide a higher closed side setting to produce a product of a desired mesh size. This characteristic in turn leads to increased crushing capacity and decreased power consumption because capacity and power consumption both vary with closed side setting. Specifically, as the closed side settings increase, power requirements fall and capacity rises. It has been discovered that the capacity of a crusher with inserts for producing product material of a particular average mesh size increases on average more than 40–50%—and sometimes more than 80%—when compared to operation of the same crusher without inserts. Moreover, the power consumption or motor amperage required to produce a product of a desired average mesh size and at a specified rate in tons per hour was reduced by 25–50% and by 35% on average as compared to power consumption of a crusher lacking inserts. The increase in capacity and the reduction in power consumption were dramatic and unexpected. Moreover, these benefits remained essentially unchanged for the life of the liner due (it is believed) to the fact that the tapered profile of the inserts were retained throughout their life as discussed above.

d. Cubicity

As discussed in the "Background" section above, cubicity is an extremely important consideration in many modern paving projects. Crushed product failing to meet the cubicity requirements cannot be screened or otherwise improved to meet these requirements and hence must be rejected. It has been discovered that a crusher incorporating inserts consistently produces product with cubicity that exceeds even the most stringent cubicity requirements. For instance, in one test, sandstone was crushed by a Telsmith Model 52FC crusher at a closed side setting of 0.75". Cubicity analysis of samples crushed with and without inserts in the crusher's mantle liner are tabulated in Table 5 and Table 6, respectively:

TABLE 5

Product Cubicity (with inserts)
Particles Measured With Proportional Caliper @ 1:3 Ratio

| | | Total | Elongated | | | | Flat | | | | % Totals | |
|---|---|---|---|---|---|---|---|---|---|---|---|---|
| Particle Size | Weight (grams) | # of Particles | Weight (grams) | % of Total | # of Particles | % of Total | Weight (grams) | % of Total | # of Particles | % of Total | Weight (grams) | # of Particles |
| 1" × ¾" | 1111.8 | 79 | 0.0 | 0% | 0 | 0 | 0.0 | 0% | 0 | 0% | 0% | 0% |
| ¾" × ½" | 610.7 | 103 | 0.0 | 0% | 0 | 0% | 1.9 | 0% | 1 | 1% | 0% | 1% |
| ½" × __" | 219.5 | 99 | 3.6 | 2% | 1 | 1% | 0.0 | 0% | 0 | 0% | 2% | 1% |

TABLE 6

Product Cubicity (without inserts)
Particles Measured With Proportional Caliper @ 1:3 Ratio

| | | Total | Elongated | | | | Flat | | | | % Totals | |
|---|---|---|---|---|---|---|---|---|---|---|---|---|
| Particle Size | Weight (grams) | # of Particles | Weight (grams) | % of Total | # of Particles | % of Total | Weight (grams) | % of Total | # of Particles | % of Total | Weight (grams) | # of Particles |
| 1" × ¾" | 1549.1 | 106 | 0.0 | 0% | 0 | 0 | 34.2 | 2% | 4 | 4% | 2% | 4% |
| ¾" × ½" | 614.3 | 105 | 9.2 | 1% | 1 | 1% | 19.4 | 3% | 4 | 4% | 5% | 5% |
| ½" × __" | 233.4 | 119 | 0.0 | 0% | 0 | 0% | 5.1 | 2% | 4 | 3% | 2% | 3% |

As illustrated in Table 5, less than 1% of the product particles produced by a crusher with inserts failed to meet the 3:1:1 cubicity requirements mandated by state highway departments, while about 4% of the product particles produced by a crusher without inserts failed to meet these standards. While it was hoped prior to testing that some improvement in cubicity would be obtained with the inserts, the magnitude of the improvements revealed by the tests were unexpected. Preliminary tests appear to reveal similar improvements in cubicity when other materials are crushed, even materials that tend to break into long, flat pieces. Moreover, the improved cubicity affects appear to be retained for the life of the wear liner. Using wear liners with hardened inserts therefore would appear to make the difference in many applications between meeting cubicity requirements for super paving projects and failing to meet those requirements.

Many changes could be made to the invention as described above without departing from the spirit thereof. The scope of these changes will become apparent from the appended claims.

We claim:

1. A rock crusher comprising:

first and second crushing means for crushing rock, said first crushing means being movable relative to said second crushing means, wherein cavities exist within at least one of said first and second crushing means; and a base, a wear liner detachably mounted on said base and presenting one of said crushing means which faces a crushing surface of the other crushing means, and insert means of a tungsten carbide/cobalt material inserted within said cavities and extending outwardly from at least one of said first and second crushing means and facing the other of said first and second crushing means for impacting and fracturing rock upon operation of said crusher, wherein said insert means exhibits a high resistance to wear and a high resistance to impact when compared to hardened steel.

2. A jaw crusher comprising:

two opposed crushing elements configured to crush to crush rock therebetween upon pivoting motion of one of said crushing elements, at least one of said crushing elements including (1) a base, (2) a wear liner detachably mounted on said base and presenting a crushing surface which faces a crushing surface of the other crushing element, said crushing surface of said wear liner having a plurality of cavities formed therein, and (3) a plurality of inserts fixed in said cavities of said wear liner and extending outwardly from said crushing surface of said wear liner towards the crushing surface of the other crushing element so as to impact and fracture rocks upon operation of said jaw crusher.

3. The crusher as defined in claim 2, wherein each of said inserts is formed from a material which exhibits a high resistance to wear and a high resistance to impact when compared to hardened steel.

4. The crusher as defined in claim 3, wherein each of said inserts is formed from a tungsten carbide/cobalt material.

5. The crusher as defined in claim 2, wherein said wear liner is generally rectangular in shape so as to have an upper end, a lower end, and opposed side edges, and wherein said inserts are arranged in straight rows extending from said upper end to said lower end.

6. The crusher as defined in claim 5, wherein the inserts of each said row are spaced non-uniformly so that the spacing between inserts is smaller near said lower end of said wear liner than near a central portion of said wear liner.

7. A crusher for crushing rock, said crusher comprising:

first and second opposed dies, at least one of which is movable relative to the other to crush rock therebetween, wherein at least one of said dies includes a base and a manganese wear liner detachably mounted on said base and presents a crushing surface which faces a crushing surface of the other die, wherein said crushing surface of said wear liner has a plurality of cavities cast therein, each of said cavities including a side wall extending inwardly from the crushing surface of said wear liner and terminating at an inner wall, wherein a plurality of inserts are fixed in said cavities, each of said inserts 1) extending outwardly from said crushing surface of said wear liner and terminating in a tapered crushing tip which faces the crushing surface of the other die so as to impact and fracture rock upon operation of said crusher, and 2) extending inwardly from said crushing surface of said wear liner towards said inner wall of the corresponding cavity, and wherein each of said inserts is formed from a tungsten carbide/cobalt material.

8. A cone crusher comprising:

two opposed crushing elements including a stationary bowl and a head rotatable eccentrically within said bowl to crush rock therebetween, at least one of said crushing elements including (1) a manganese wear liner mounted on at least a portion of said at least one crushing element presenting a crushing surface which faces a crushing surface of the other crushing element, said crushing surface having a plurality of cavities cast therein, and (2) a plurality of inserts press-fit in said cavities and extending from said crushing surface outwardly and towards a crushing surface of the other crushing element so as to impact and fracture rock upon operation of said gyratory crusher.

9. The cone crusher of claim 8, wherein each of said inserts is formed from a material which exhibits a high resistance to wear and a high resistance to impact when compared to hardened steel.

10. A method of crushing rock comprising:

orientating a first crushing element opposite a second crushing element to form a gap therebetween, wherein said first and second crushing elements include crushing surfaces formed from manganese wear liners, wherein said crushing surface of at least one of said first and second crushing elements includes a plurality of inserts that extends outwardly and towards the other of said first and second crushing elements, wherein said inserts exhibit a high resistance to wear and a high resistance to impact when compared to hardened steel;

placing rock into said gap; and moving at least one of said crushing elements relative to the other of said crushing elements to a position in which said inserts impact and fracture rock in said gap.

11. The method of claim 10, wherein each of said first and second crushing elements comprises a respective die, and wherein the moving step comprises pivoting at least one of said first and second dies relative towards the other of said dies to crush rock in said gap.

12. The method of claim 10, wherein said first crushing element comprises a stationary bowl and said second crushing element comprises a rotatable head, and wherein the moving step further comprises rotating said head eccentrically within said bowl to crush rock in said gap.

13. The method of claim 10, wherein each of said inserts is formed from a tungsten carbide/cobalt material.

* * * * *